United States Patent [19]

Winblad

[11] Patent Number: 4,693,182

[45] Date of Patent: Sep. 15, 1987

[54] AMMUNITION UNIT

[75] Inventor: Nils Winblad, Karlskoga, Sweden

[73] Assignee: Aktiebolaget Bofors, Bofors, Sweden

[21] Appl. No.: 755,862

[22] Filed: Jul. 17, 1985

[30] Foreign Application Priority Data

Jul. 17, 1984 [SE] Sweden ..... 8403738

[51] Int. Cl.[4] ..... F42B 15/26

[52] U.S. Cl. ..... 102/476

[58] Field of Search ..... 102/383, 473, 475, 476, 102/480, 489

[56] References Cited

U.S. PATENT DOCUMENTS

| | | | |
|---|---|---|---|
| 3,016,014 | 1/1962 | Lebourg . | |
| 4,262,596 | 4/1981 | Allier et al. | 102/476 |
| 4,374,495 | 2/1983 | Thomanek | 102/476 |
| 4,455,943 | 6/1984 | Pinson | 102/489 |
| 4,538,519 | 9/1985 | Witt et al. | 102/475 X |

FOREIGN PATENT DOCUMENTS

| | | |
|---|---|---|
| 2153994 | 5/1973 | Fed. Rep. of Germany . |
| 2401400 | 3/1979 | France . |
| 2025009 | 1/1980 | United Kingdom . |
| 2149066 | 6/1985 | United Kingdom . |

*Primary Examiner*—Deborah L. Kyle
*Assistant Examiner*—Ted L. Parr
*Attorney, Agent, or Firm*—Pollock, Vande Sande & Priddy

[57] ABSTRACT

An ammunition unit (1) comprising a shaped-charge warhead which can be ignited by means of direct impact on a target (15), by means of a proximity fuze (16,17) and/or an external signal (29). The warhead has preferably an inclined position so that its longitudinal axis (5,5') is forming an angle with respect to the longitudinal axis (1*b*) of the unit. The warhead (4,4') is tiltable in the unit from said initial position into another inclined position depending on the type of ignition. In case of an overflying missile its warhead is directed towards the rear parts of a target, i.e. on the other side of the target seen from the direction of the flight.

9 Claims, 5 Drawing Figures

(A-A)

AMMUNITION UNIT

TECHNICAL FIELD

The present invention relates to an ammunition unit comprising a shaped charge warhead which can be ignited by means of a direct impact on a target or by means of a proximity fuze signal and/or an external signal.

STATE OF THE ART

From GB-PS No. 2 006 935 is has been previously known to provide an ammunition unit, such as a missile, with one or more shaped charges arranged in a tilted position so that their longitudinal axes have a specific inclination angle with respect to the longitudinal axis of the missile. One of the embodiments also illustrates a plurality of shaped charges orientated so that each charge has its own, individual inclination angle.

By such orientation of the shaped charges their angle of impact is changed compared with the in flight trajectory of the missile to optimize the effect upon a target with heavy frontal armor, such as a battle tank, a bunker or the like.

In the case of a rotating ammunition unit it is also previously known to sense the rotational position for igniting the warhead at a moment when it is pointing at the target or at a specific vital point on the target.

SUMMARY OF THE INVENTION-TECHNICAL PROBLEM

It is still therefor desirable, however, to improve the destroying effect of these types of ammunition units such as missiles, projectiles on heavy frontal armor protected targets.

It is also desired that the destroying effect on a target upon a direct hit or proximity fuze ignition is maintained. It is also advantageous to use a more favourable angle of impact against targets with very complex and heavy frontal armor protection.

SOLUTION

The main object of the present invention is to provide an ammunition unit, such as an antitank missile, which solves the above problems. According to the invention the missile is provided with one or more movable parts, which can be moved in the missile into a specific inclined position to optimize the effect on armor protected targets.

The main characterizing feature of this invention is that each shaped-charge warhead can be moved from a first, initial position into another inclined position depending on the type of ignition.

In a preferred embodiment of the invention the warhead is arranged to be tilted about an axis which is perpendicular to the longitudinal axis of the missile so that it is tilted from an initial, inclined position of approximately 30° to an end position of approximately 150°, depending on the space available and applicability. The tilting movement can be initiated by means of a proximity fuze signal and effectuated by tilting means, such as one or more impulse motors, located on each side of the smaller part of the warhead. Alternatively, the tilting movement can be effectuated by tilting means in the form of an operating cylinder in which the piston head and piston rod are actuated by a propulsive charge, so that the actuating force is mechanically connected to a working lever on the warhead. As a supplement or another alternative to tilting means also aerodynamical means can be used for the tilting movement. When the warhead is tilted the missile casing over and under the warhead is preferably opened along a bisector. The openings are made for instance by swinging lids or lids which are thrown away.

The tilting means are preferably arranged so that the end of the passage over the target the warhead is directed towards the rear parts of the target seen from the direction offlight. The tilting movement can also be controlled in such a way that during the missile passage of the target the warhead is kept on less protected areas of the target.

ADVANTAGES

By using such a tiltable warhead at least four different igniting conditions are obtained. As a first condition the shaped charge can be ignited by means of a conventional direct impact upon the target, independent on any proximity fuze signal or any other corresponding igniting function. As a second condition the charge can be ignited in its end position after the tilting movement and by a proximity fuze signal or ignited by a direct impact upon the target during the tilting movement. As a third condition the charge can be ignited with a short delay after it has been activated by a proximity fuze or any other external signal activation. A short delay can also be set before firing, if desired. The charge is then not fully tilted, for example tilted only during the delay time. The particular case with delay time equal 0 should then be included. As a fourth condition the charge can be ignited by means of an external signal.

The best effect on side targets is normally achieved by means of a proximity fuze ignition in the conventional way. The only advantage to hit a side target from its other side is that the enemy may be confused about the location of the gunner. The above is true especially for "thin" targets with corresponding very short tilting times for the warhead.

Against front targets with a heavy frontal armor a hit from the rear is more efficient. Even upon a direct impact during the tilting movement the effect is greatly enhanced as the charge is inclined more than 30°. The most vulnerable part of a battle tank is normally the rear side of the turret with the ammunition and crew compartments. For the greatest effect on the tank, notation of the activated proximity fuze should be made.

BRIEF DESCRIPTION OF THE DRAWINGS

A preferred embodiment of the invention will now be described in connection with the accompanying drawing in which.

DESCRIPTION OF THE PREFERRED EMBODIMENT

Figures 1, 1A, 2, 3, 4:
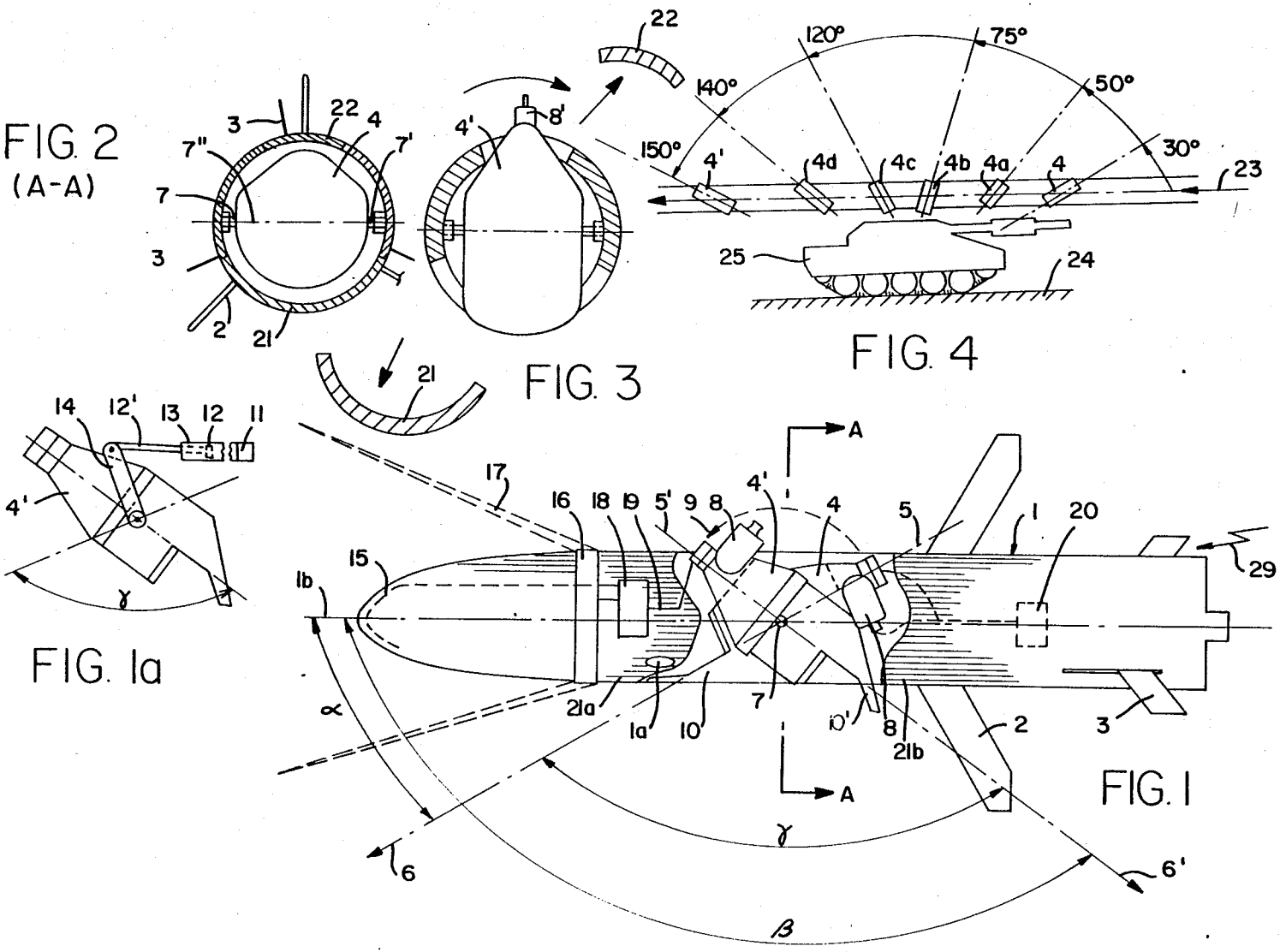
FIG. 1 illustrates the invention in a missile, in a sideview and partly sectioned, with a warhead in its initial as well as in its tilted end position.
FIG. 1*a* illustrates in a sideview another tilting means for the warhead.
FIG. 2 illustrates a section taken along A—A of the missile with removable lids in the casing of the missile body, FIG. 3 also a section taken along A—A but with the lids removed and the warhead in its tilting phase, and FIG. 4 a schematic sideview illustrating the missile passing a battle tank with the tilting orientation of the warhead indicated.

FIG. 1 illustrates an ammunition unit in which the present invention can be used. The ammunition unit in itself may be a conventional missile 1, comprising a flight motor (not illustrated here) with outlets 1*a*. The missile also comprises ignition means, electronics, gyro means, electrical energy sources etc, which also are known in the art and not described here. The rear part of the missile is provided with a number of wings 2, for instance three, uniformly distributed about the periphery of the missile body. Furthermore the missile is provided with rudders 3, also uniformly distributed about the periphery, for instance four rudders 3. The missile also comprises a shaped-charge warhead 4 with a longitudinal axis 5. The warhead is a complete unit which upon ignition generates a penetrating jet which essentially coincides with the longitudinal axis 5 of the warhead and runs in the direction indicated by the arrow 6 in the drawing. The warhead is journalled on bearings 7 on an axis perpendicular to the longitudinal axis 1*b* of the missile. In the illustrated embodiment this axis is also sharing the longitudinal axis 1*b*. The warhead is tiltable about bearings 7 from an initial position 4 to an end position indicated by 4', 5' and 6'. In the initial position the warhead is inclined so that the warhead axis 5 has an angle $\alpha$ with the longitudinal axis 1*b* of the missile. In its tilted end position 4' the warhead axis 5' has an angle $\beta$ with the same longitudinal axis 1*b*. The angle $\alpha$ is in this case approximately 30°, but this is only an example and the angle $\alpha$ can be more or less, even 0°. The angle $\beta$ is preferably about 150°, but includes also other angles. In the illustrated embodiment the total tilting angle $\gamma$ is about 120°.

The warhead itself is conventional and comprises a main charge and igniting means for this charge. The warhead has been provided, however, with tilting means, preferably one or two impulse motors 8, also known in the art. The impulse motors are then orientated perpendicular to the warhead axis 5. Each impulse motor is located in a distance from the tilting axis 7 of the warhead. When the impulse motors are initiated a force is imposed on the warhead perpendicular to its axis 5 moving the warhead from its initial position towards its end position indicated by 4', 5' in FIG. 1. The direction of this angular movement is indicated by the arrow 9. The warhead has a cylindrical part as well as a conical, tapered part. The impulse motors are preferably applied on the smaller conical part of the warhead, and with two motors, one on each side of the tapered part of the warhead cooperating to provide the necessary tilting force on the warhead.

It should be understood that the tilting movement of the warhead can be generated also in other ways. In FIG. 1 the tilting movement is achieved by means of an aerodynamic flag or wing 10, 10'. Another tilting means are illustrated in FIG. 1*a*. Here a propulsive charge 11 is acting upon a piston head 12 in an operating cylinder 13. The piston head is connected with a working lever 14 to provide a tilting force on the warhead 4', which is then moved into its tilted end position. In this case a counteracting moment is also obtained in the missile, but this moment is comparatively small.

The missile preferably comprises an impact fuze 15 in its nose section and/or a proximity fuze 16 transmitting optical beams 17. Signals from the impact fuze 15 or from the proximity fuze 16 are received by the electronics 18 igniting the warhead via connection line 19. The missile also preferably comprises safety arming devices 20 connected to the impulse motors and the propulsive charge 11.

As illustrated in FIGS. 2 and 3 the missile casing is provided with swinging or removable covers or lids 21 and 22 or fracture indications in the casing wall. This means that the warhead body is allowed to be tilted partly out from the missile surface, which makes possible a use of an optimal warhead within the missile body. The arrangement of the fields on the missile body is not described in detail, since they can be arranged in the same manner as conventional aircraft lids. The lid 21 on the under side of the missile is wider and longer than the other lid. In FIG. 1 the outer limits 21*a* and 21*b* have been indicated on the under side of the missile. The lids make possible for the aerodynamical flag to swing out and allow the penetrating jet of the hollow charge to be working undisturbed within the entire angle interval. As soon as the lid 21 has been opened or removed the air stream around the missile body hits the flag 10, 10' and provides an additional tilting force on the warhead. The upper parts of the warhead and the impulse motors 8, 8' are allowed to swing out over the missile surface as soon as the lid 22 has been opened or removed. Even the piston rod 12' (see FIG. 1*a*) and the lever arm 14 are outside the missile surface during the tilting movement through the opening in the missile casing after the lid 22.

In FIG. 2 the bearings are indicated by 7, 7' and the tilting axis by 7''.

The missile is preferably non-rotating (roll stabilized) but can also be rotating. Then the missile may be provided with, or cooperating with, means for sensing the rotational position of the missile for igniting the warhead at a moment when it is pointing, see arrow 6 and 6' in FIG. 1, at the target or at a specific vital point on the target.

When the invention is used on missiles or other ammunition units with an overflying speed of for instance 200 m/s the warhead must be tilted during a time interval not exceeding 20–40 ms. FIG. 4 shows one example with a battle tank of approximately 5 m in the longitudinal direction and in front projection to the gunner. The missile flight path, indicated by 23, is essentially parallell to the ground surface 24 and elevated with respect to the tank target 25. The proximity fuze should be activated as soon as the transmitted beam is sensing the front of the tank. The warhead has a inclined position downwards of approximately 30°. The proximity fuze signal initiates the tilting movement of the warhead from the initial position 4 towards the tilted end position 4'. FIG. 4 illustrates the tilting phase during the passage over the target. The hit point of the penetrating jet depends on the kind of initiation of the charge, i.e. direct impact during passage or if the end position has been reached and if a specific delay time has been used. The hit point also depends on the height of the flight path.

In FIG. 4 four different intermediate positions 4*a*, 4*b*, 4*c* and 4*d* of the warhead have been indicated during the continuous tilting movement at the tilting angles 50°, 75°, 120° and 140°, respectively. The total tilting movement amounts to 120°, i.e. 150°–30°, provided that the end position of the warhead has been reached.

The most favorable hit point on the tank target in the example illustrated in FIG. 4 is on the rear part of the turret roof having a damage effect in the ammunition and crew compartments or on the roof of the motor and transmission of the tank. A hit on the rear part of the turret roof corresponds to a tilting angle of 120° on a tilting distance of approximately 5 m. This means that the warhead must be rotated 120° on 25 ms. If the warhead is initiated after for instance 35 ms and a distance of 7 m this means a hit on the motor and transmission roof. On the other side a great damage effect is also obtained if the proximity fuze is activated by the gun muzzle or specific means mounted on the gun barrel for its activation.

From the above considerations it should be understood that the tilting of the warhead must be effectuated in a comparatively rapid way, for instance within 20 to 50 ms. As the weight of the warhead is comparatively small such a tilting time is quite possible for such tilting means which have been mentioned here. Thanks to the rotation of the warhead the penetrating effect of the hollow charge jet has been increased as the jet fragments are converging towards the target. This means that the so-called key-hole effect has been reduced, which is an advantage with respect to the penetration ability as well as a secondary introduction of material through the penetration into the target body.

The missile can be provided with one or more warheads. The initiation of each warhead can be made in the same way as in the case of single warhead, i.e. by means of an impact fuze, by means of a proximity fuze and in end position or after a specific delay or by means of an external signal.

The invention is not limited to the above examples but can be modified within the scope of the following claims.

I claim:

1. An ammunition unit comprising: an elongated casing and a shaped charge warhead ignited by means of a direct impact on a target by means of a proximity fuze and an external signal, said warhead being movable in the casing from a first, initial position into a second inclined position, said movement occurring about a tilting axis perpendicular to the longitudinal axis of said casing, and a tilting means performing said movement of said warhead into said inclined position.

2. An ammunition unit according to claim 1, wherein said tilting means are activated by an arming device, in response to an external signal and a sensing means further provided in the unit.

3. An ammunition unit according to claim 2 wherein said tilting means comprises impulse motors, an operating cylinder means and means activated by the air stream around the unit.

4. An ammunition unit according to claim 2 wherein said tilting means comprises impulse motors and means activated by the air stream around the unit.

5. An ammunition unit according to claim 1, wherein the warhead, in said first initial position, is inclined with respect to a longitudinal axis of the ammunition unit, wherein the inclination angle is in a range of about 10°-40°.

6. An ammunition unit according to claim 1, wherein said tilting means are arranged, at the end of passage over a target, to direct the warhead towards rear parts of the target seen from the inflight direction of said warhead.

7. An ammunition unit according to claim 6 wherein the tilting means control the warhead during the passage of the target to maintain aiming said warhead on a specific vital part of the target.

8. An ammunition unit according to claim 1, further comprising a casing having openings to allow the warhead to be extended outside said casing during the tilting movement wherein said openings are covered by lids, said lids moving outwardly upon activation of the tilting means.

9. An ammunition unit comprising: an elongated casing and a shaped charge warhead ignited by an external signal, said warhead being movable in the casing from a first, initial position into a second inclined position, said movement occurring about a tilting axis perpendicular to the longitudinal axis of said casing, and a tilting means for performing said movement of said warhead into said indined position.

* * * * *